US010767284B2

(12) United States Patent
Baur et al.

(10) Patent No.: US 10,767,284 B2
(45) Date of Patent: Sep. 8, 2020

(54) THREAD DRAW-OFF NOZZLE HAVING NOTCHES EXTENDING RADIALLY TO THE NOZZLE BORE

(71) Applicant: Maschinenfabrik Rieter AG, Winterthur (CH)

(72) Inventors: Guenter Baur, Suessen (DE); Michael Basting, Suessen (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 15/773,574

(22) PCT Filed: Nov. 2, 2016

(86) PCT No.: PCT/EP2016/076323
§ 371 (c)(1),
(2) Date: May 4, 2018

(87) PCT Pub. No.: WO2017/076847
PCT Pub. Date: May 11, 2017

(65) Prior Publication Data

US 2018/0320292 A1 Nov. 8, 2018

(30) Foreign Application Priority Data

Nov. 6, 2015 (DE) ..... 10 2015 119 112

(51) Int. Cl.
*D01H 4/40* (2006.01)
*D01H 4/10* (2006.01)

(52) U.S. Cl.
CPC ..... *D01H 4/40* (2013.01); *D01H 4/10* (2013.01)

(58) Field of Classification Search
CPC ..... D01H 4/10; D01H 4/40
(Continued)

(56) References Cited

U.S. PATENT DOCUMENTS 3,640,061 A * 2/1972 Landwehrkamp ..... D01H 4/40 57/417
3,805,505 A * 4/1974 Schuster ..... D01H 4/40 57/417

(Continued)

FOREIGN PATENT DOCUMENTS

DE 3419300 A1 * 11/1985 ..... D01H 4/40
DE 199 06 111 A1 10/2000

(Continued)

OTHER PUBLICATIONS

PCT Search Report, dated Jan. 25, 2017.
IPRP—dated May 17, 2018.
PCT Written Opinion—dated May 8, 2018.

*Primary Examiner* — Khoa D Huynh
*Assistant Examiner* — Grace Huang
(74) *Attorney, Agent, or Firm* — Dority & Manning, P.A.

(57) ABSTRACT

A thread draw-off nozzle for an open-end rotor spinning device includes an entrance-side nozzle funnel and an exit-side nozzle bore adjoining the nozzle funnel. A plurality of notches are arranged in the nozzle funnel and extend essentially radial to the nozzle bore. Each notch has an inlet wall, a baffle wall, a radially outer notch inlet, and a radially inner notch outlet. Each notch further includes an essentially flat notch bottom arranged between the inlet wall and the baffle wall.

11 Claims, 4 Drawing Sheets

(58) Field of Classification Search
USPC ..... 57/401
See application file for complete search history.

(56) References Cited

U.S. PATENT DOCUMENTS

| | | | | | |
|---|---|---|---|---|---|
| 3,812,667 | A * | 5/1974 | Marsalek | D01H 4/10 | 57/416 |
| 3,965,661 | A * | 6/1976 | Yoshida | D01H 4/40 | 57/417 |
| 4,237,682 | A * | 12/1980 | Miyamoto | D01H 4/10 | 57/416 |
| 4,571,932 | A * | 2/1986 | Stahlecker | D01H 4/18 | 57/335 |
| 4,610,134 | A * | 9/1986 | Busch | D01H 4/40 | 57/417 |
| 5,265,406 | A * | 11/1993 | Hofmann | D01H 4/40 | 57/417 |
| 5,423,177 | A * | 6/1995 | Raasch | D01H 4/40 | 57/417 |
| 5,437,147 | A * | 8/1995 | Mackey | D01H 4/40 | 57/417 |
| 5,873,231 | A * | 2/1999 | Tjin | D01H 4/10 | 57/416 |
| 6,269,623 | B1 * | 8/2001 | Phoa | D01H 4/40 | 57/417 |
| 6,286,295 | B1 * | 9/2001 | Lang | D01H 4/40 | 57/416 |
| 6,347,506 | B1 | 2/2002 | Backmeister | | |
| 2002/0020163 | A1 * | 2/2002 | Slezak | D01H 4/40 | 57/404 |
| 2017/0342605 | A1 * | 11/2017 | Loos | D01H 4/40 | |
| 2018/0320293 | A1 * | 11/2018 | Baur | D01H 4/40 | |

FOREIGN PATENT DOCUMENTS

| | | | | |
|---|---|---|---|---|
| DE | 199 49 533 | A1 | 4/2001 | |
| DE | 103 18 305 | A1 | 10/2004 | |
| EP | 1 158 080 | A1 | 11/2001 | |
| EP | 1445358 | A2 * | 8/2004 | D01H 4/40 |
| GB | 1503991 | A * | 3/1978 | D01H 4/40 |
| GB | 1568070 | A * | 5/1980 | D01H 4/40 |

* cited by examiner

THREAD DRAW-OFF NOZZLE HAVING NOTCHES EXTENDING RADIALLY TO THE NOZZLE BORE

FIELD OF THE INVENTION

The present invention relates to a thread draw-off nozzle for an open-end rotor spinning device with an entrance-side nozzle funnel and an exit-side nozzle bore adjoining the nozzle funnel. In the area of the nozzle funnel, notches extending in a manner essentially radial to the nozzle bore are arranged. The notches feature an inlet wall and a baffle wall, along with a radially outer notch inlet and a radially inner notch outlet.

BACKGROUND

Thread draw-off nozzles have become known in the state of the art in many designs for open-end rotor spinning devices. Such thread draw-off nozzles have the task of deflecting the spun yarn upon being drawn off from the spinning device and giving the drawn-off yarn a false twist. Since, in the freshly spun yarn, the true yarn twist is introduced predominantly between the thread draw-off nozzle and the draw-off device, but does not propagate sufficiently into the rotor groove, the spin stability can be substantially increased by introducing a false twist by means of the thread draw-off nozzle. To introduce the false twist, the thread draw-off nozzles feature surface structures, which, in principle, have proven to improve spinning stability, but at the same time also have a considerable influence on the quality of the spun yarn. Spiral elevations or radially arranged notches are predominantly used as surface structures. In general, spiral nozzles are considered to be advantageous for yarn quality, but frequently offer less spin stability. On the other hand, notched nozzles are well-suited to increase spinning stability, but are considered more aggressive with respect to yarn quality.

As such, efforts have already been made to find a thread draw-off nozzle that meets both requirements in equal measure. For example, DE 199 06 111 A1 proposes a thread draw-off nozzle with notches arranged radially in the area of the nozzle funnel, whereas the notches are configured asymmetrically. The asymmetric notch is formed such that the thread first passes over a very flat inlet wall gently into the notch base, where it is then abruptly stopped by the steep baffle wall. Given this asymmetric configuration of the notches, the skipping over of the notches by the circumferential thread is avoided.

According to DE 103 18 305 A1, it is provided that a thread draw-off nozzle is provided with radially extending, asymmetrical notches, which are curved in a sickle-shaped manner. The curvature of the notches is designed to be counter to the curvature of the crank-like circumferential yarn. This is to be able to achieve a different effect on the yarn by means of a single notch. Thus, in the area of the front surface, an increased false twist effect is to be achieved, which improves spinning stability, while, in the direction of the yarn draw-off channel outweigh, it is to outweigh the effect of the baffle wall, which temporarily stops the thread.

SUMMARY OF THE INVENTION

A task of the present invention is to propose a thread draw-off nozzle that enables a high degree of spinning stability and nevertheless reduces negative influences on yarn quality. Additional objects and advantages of the invention will be set forth in part in the following description, or may be obvious from the description, or may be learned through practice of the invention.

A thread draw-off nozzle for an open-end rotor spinning device features an entrance-side nozzle funnel and an exit-side nozzle bore that adjoins the nozzle funnel. Notches that extend in a manner essentially radial to the nozzle bore are arranged in the area of the nozzle funnel, whereas the notches feature an inlet wall and a baffle wall along with radially outer notch inlet on the outside and a radially inner notch outlet. With the present thread draw-off nozzle, it is provided that a notch bottom that is preferably designed to be even and flat is arranged between the inlet wall of the notch and the baffle wall. Thus, the inlet wall and the baffle wall do not abut each other directly in the area of the notch base, which, in the state of the art, has often been designed to be rounded. Therefore, the thread entering through the inlet wall runs along the notch in a defined manner, and is securely guided to the notch base. By contrast to this, with V-shaped notches that were previously customary, despite gently descending inlet flanks, it was still the case that the thread does not reach the notch base, but jumps in an undefined manner from the inlet ramp to the outlet ramp.

Preferably, the notch bottom features a width of between 0.16 mm and 0.22 mm, in particular between 0.18 mm and 0.20 mm. The thread can be braked gently during its travel over the notch bottom, and can slide in the direction of the baffle wall. Thus, the thread is exposed to the effect of the notch securely and over a longer period of time, whereas, at the same time, the yarn-damaging effect of the notches is reduced. It has been found that, with such a width of the notch bottom, an optimal compromise can be achieved between, on the one hand, the effect of the notches (which increases spinning stability) and, on the other hand, yarn quality.

As such, it is also advantageous if the notches feature a flatter inlet wall and a steeper baffle wall, wherein "flatter" (less slope) is relative to the notch bottom 12 as compared to the baffle wall 9, wherein "steeper" (greater slope) is relative to the notch bottom 12, for example, as illustrated in FIG. 2; wherein, for each notch, the baffle wall has at least one baffle wall angle, the inlet wall has at least one inlet wall angle, and the at least one baffle wall angle is steeper than the at least one inlet wall angle relative to the notch bottom. The skipping over of the notches by the thread can thereby also be avoided, and the thread is securely guided to the baffle wall briefly restraining it.

For a better propagation of rotation into the rotor groove, it is also advantageous if the notch outlet is arranged in an entrance area of the nozzle bore. Thus, the notch extends into the nozzle bore and is thereby designed to be comparatively steep. The thread can better enter into the notches, and thus experiences a particularly significant change in length in the circumferential yarn shank. Thereby, the change in length and thus also the thread tension tip produced by the notch is greater, as the notch is steeper. Due to the steeper running out of the notches in the nozzle bore, a smoother transition upon reaching and leaving the notch is thereby achieved at the same time, such that negative influences of the notches on yarn quality can be avoided.

It is advantageous if the notch outlet is arranged at a depth of between 0.1 mm and 0.5 mm away from an entrance of the nozzle bore. With such an arrangement of the notch outlet, the thread can be guided into the notches in a particularly secure manner, and a steep notch is achieved.

Since the notch, as a whole also in the direction of drawing off, viewed in the direction of the nozzle bore, is offset from the nozzle funnel, the shank-shaped circumferential yarn piece sweeping less than previously through the notch inlet is also achieved. This also helps to avoid the skipping over of the thread. Likewise, this reduces any yarn-damaging effect of the notch inlet and improves yarn quality.

For achieving good yarn quality, it is also advantageous if the nozzle funnel features, in the area of the notch inlets, a circumferential recess, in particular a circumferential, preferably rounded, groove. The recess can be directly adjacent to the notch inlets. It is likewise possible that, through the recess, an upper area of the notches with the original notch inlets is removed, and new notch inlets that are now located deeper in the nozzle funnel arise at the transition of the recess to the notch. The recess itself can extend to the front surface of the nozzle funnel, or also only break up the surface of the nozzle funnel. Due to such a recess, any aggressive effect of the notch inlet on the thread can be further reduced. Instead of a circumferential groove, it is also possible to form the recess, for example, through a spherical recess.

It is also advantageous if the inlet wall and/or the baffle wall are formed as flat surfaces; that is, non-curved surfaces. Preferably, the notch bottom between the baffle wall and the inlet wall is formed as a flat surface. The thread is thereby guided in a defined manner within the notch over its entire length, and the production of the thread draw-off nozzle is thereby facilitated. FIG. 2 illustrates such an example.

If the inlet wall and/or the baffle wall are formed to be kinked and/or bent, in this manner, a thread treatment that is more gentle than with a non-curved surface can take place. Due to the kinked or bent surface, the steep surface is reduced and, due to a flatter surface, it is continued up to the top side of the nozzle. FIG. 7 illustrates such an example.

It is particularly advantageous if an angle of the baffle wall to a center notch plane amounts to between 32.5° and 47.5°, preferably between 35° and 45°, more preferably between 37° and 42°. Thus, the baffle wall is designed to be comparatively flat relative to the notch bottom. Thereby, the release of the thread after its braking by the baffle wall can likewise be more gentle, and an undefined jumping of the thread can also be avoided.

In the case of a kinked or bent inlet wall and/or baffle wall, it is advantageous if a first angle ($\beta_1$) of a first part of the baffle wall or a first angle ($\alpha$1) of a first part of the inlet wall is defined and a second angle ($\beta_2$) of a second part of the baffle wall is flatter than the first angle ($\beta$1) or a second angle ($\alpha$2) of a second part of the inlet wall is flatter than ($\alpha$1).

As such, the at least one baffle wall angle comprises a first angle ($\beta_1$) and a second angle ($\beta_2$), wherein the first angle ($\beta_1$) of a first part of the baffle to a center notch plane is between 32.5° and 47.5°, and the second angle ($\beta_2$) of a second part of the baffle wall to the first part of the baffle wall is between 10° and 20°, for example, as illustrated in FIG. 7. Thereby, the thread is guided very gently.

For the secure guidance of the thread up to the notch base or notch bottom, it is advantageous if the angle of the inlet wall to a center notch plane amounts to between 50° and 65°, preferably between 52° and 60°, more preferably between 54° and 58°, wherein the at least one inlet wall angle comprises an angle (a), wherein the angle (a) of the inlet wall to a center notch plane is between 50° and 65°, for example, as illustrated in FIG. 2.

Thus, the notch angle between the inlet wall and the baffle wall advantageously amounts to between 80° and 115°, preferably between 85° and 110° and more preferably between 96° and 100°. Such values have proved to be optimal for guiding the thread securely into the notch and nevertheless braking gently.

In order to securely release the thread after braking, the depth of the notch preferably amounts to between 0.14 mm and 0.25 mm, preferably between 0.16 mm and 0.22 mm and more preferably between 0.16 and 0.20 mm.

BRIEF DESCRIPTION OF THE DRAWINGS

Additional advantages of the invention are described on the basis of the following presented embodiments. The following is shown.

DETAILED DESCRIPTION

Figure 1:
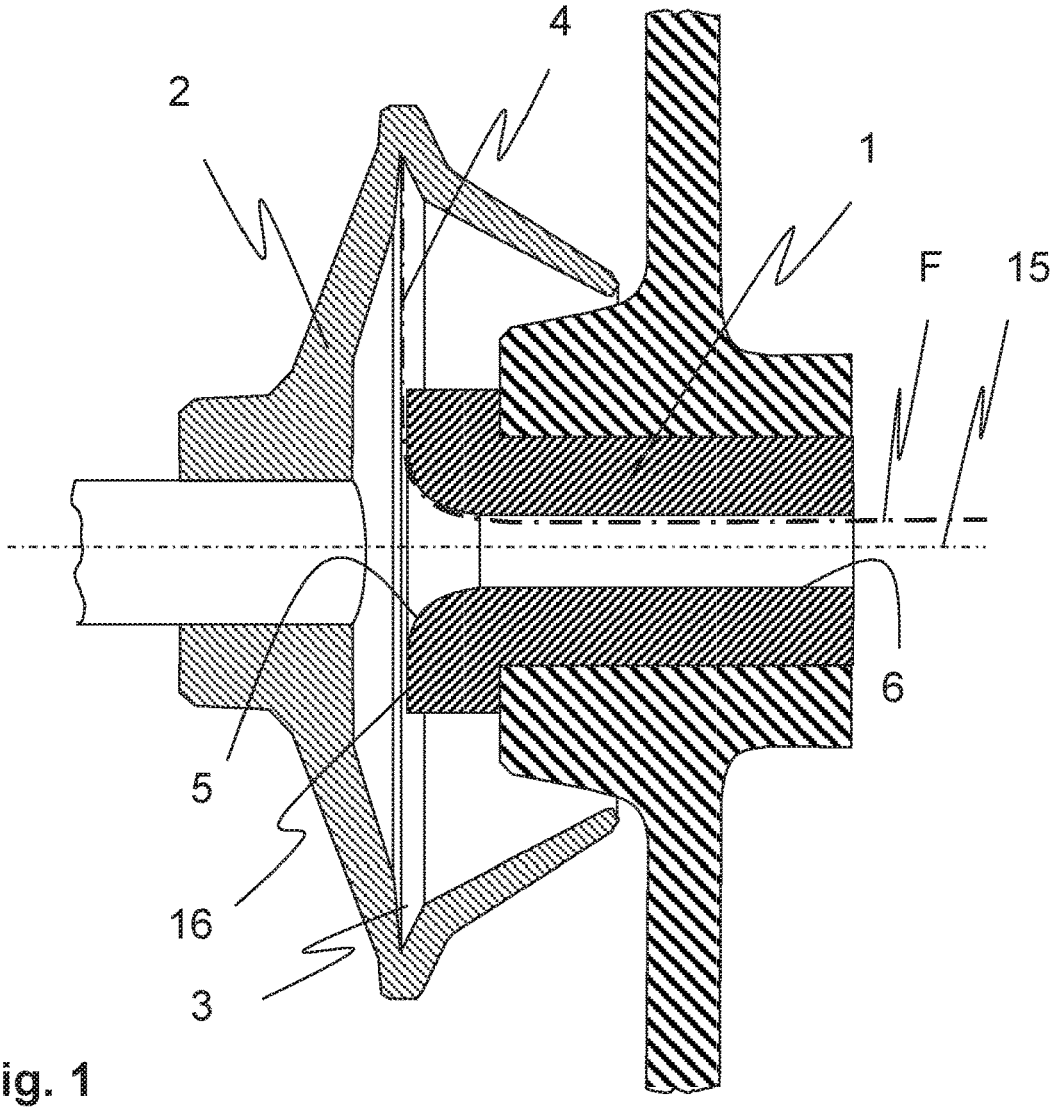
FIG. 1 is a schematic view of an open-end spinning device with a spinning rotor and a draw-off nozzle.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic sectional view of a spinning rotor 2 and a thread draw-off nozzle 1 in an open-end spinning device, which is shown only partially in the present case. To produce a thread F, the spinning rotor 2 is fed in a known manner with a fiber material broken down into individual fibers. During yarn production, the spinning rotor 2 runs at high rotational speeds, such that the fibers that are fed are deposited in the rotor groove 3 of the spinning rotor 2 in the form of a fiber ring. The newly spun thread F is drawn off continuously via the thread draw-off nozzle 1 and, with its end, extends into the rotor groove 3 of the spinning rotor 2. Thus, due to the rotation of the spinning rotor 2, a crank-like circumferential yarn shank 4, in which the fibers deposited in the rotor groove 3 are integrated, arises.

The thread draw-off nozzle 1 features, in the customary manner, a cylindrical nozzle bore 6 and a nozzle funnel 5, which forms a curved yarn deflection surface for the thread F to be drawn off. Finally, a front surface 16 of the thread draw-off nozzle 1 adjoins the nozzle funnel 5, on the side of the thread draw-off nozzle 1 turned away from the nozzle bore 6; such front surface 16 can be formed to be sloping in different manners, for example, flat, curved, or in the direction of the head diameter $D_K$ of the thread draw-off nozzle 1. The nozzle bore 6 is typically coaxial relative to the axis of rotation 15 of the spinning rotor 2, such that, during its drawing off out of the rotor groove 3, the drawn-off thread F is deflected over the deflection surface of the nozzle funnel 5 by about 90°. As described above, it is desirable that the rotation introduced into the thread propagates as far as possible into the rotor groove 3, in order to achieve the best possible spinning stability. For this purpose, the surface of the nozzle funnel 5 is provided with notches 7 (see FIG. 2) or elevations. Although such structures increase spinning stability, they can also impair yarn quality, in particular in case that there are notches.

Figure 2:
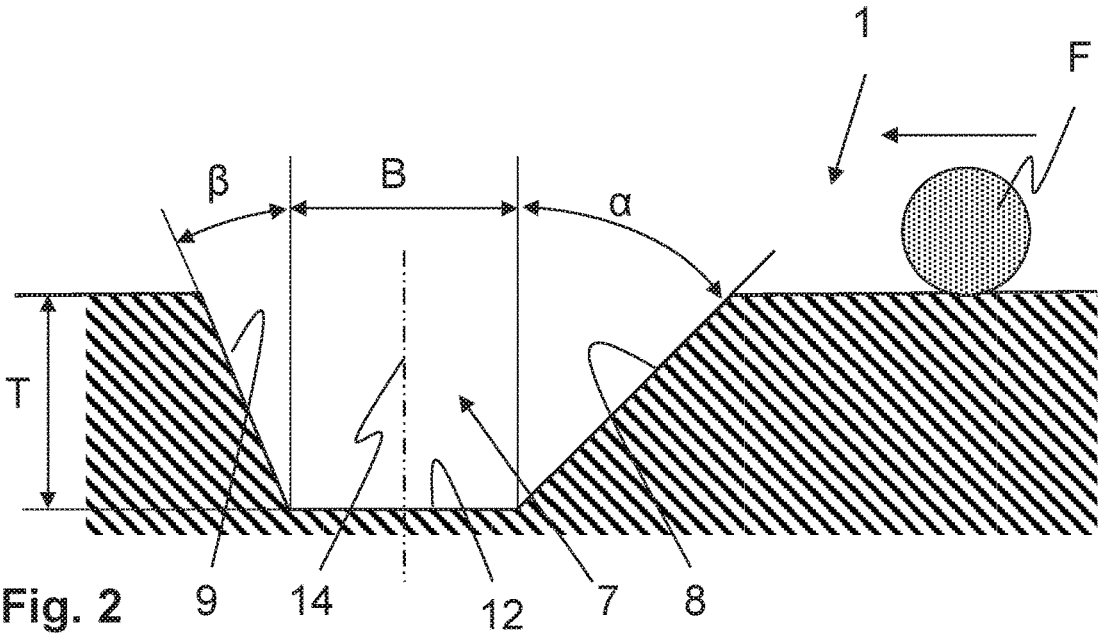
FIG. 2 is a schematic view of a notch of a thread draw-off nozzle with a notch bottom.

FIG. 2 shows a schematic section through a notch 7 of a thread draw-off nozzle 1, with which a particularly good and reliable effect of the notch 7 on the drawn-off thread F can be ensured. The notch 7 features, in a manner known per se, an inlet wall 8 and a baffle wall 9, which the thread F reaches in succession during its crank-shaped circulation over the nozzle funnel 5. In the present case, the direction of rotation of the thread F is symbolized by an arrow. However, in contrast to previously known notch shapes of the state of the art, which have always been designed to be V-shaped, it is now provided that the inlet wall 8 and the baffle wall 9 do not directly adjoin one another; rather, a defined notch bottom 12 with a defined width B extends between the inlet wall 8 and the baffle wall 9. In the present case, the notch bottom 12 is formed to be completely flat. Thereby, the notch 7 features a simple geometric structure, which is easy to manufacture. The arrangement of the notch bottom 12 between the inlet wall 8 and the baffle wall 9 ensures that the thread F reaches the notch base in each case, which in this case is designed as a flat notch bottom 12. An undefined jumping of the thread F from the inlet wall 8 directly on the baffle wall 9, as it often occurred in the state of the art, can thereby be avoided.

It is thus ensured that the thread F reaches the notch bottom 12 and thereby undergoes a sufficient change in length in the circumferential yarn shank 4.

According to the present illustration, the secure reaching of the notch bottom 12 is still supported by the fact that the thread F is led over a comparatively flat inlet wall 8 slowly and gently relative to and in the direction of the notch bottom 12. The angle $\alpha$ to a center notch plane 14 or to a parallel thereto, as the case may be, preferably amounts to between 54° and 58° and is designed, for example, at 56°. The notch bottom 12 further features a width B of between 0.18 mm and 0.24 mm. For example, the width B of the notch bottom amounts to 0.22 mm. However, the angle $\beta$ of the baffle wall 9 relative to the center notch plane 14 preferably amounts to between 37° and 42°. According to a particularly advantageous embodiment, the angle $\beta$ amounts to 40°. With such an angle $\beta$ of the baffle wall 9, the thread F can be braked in a particularly advantageous manner, indeed in a desirable manner, but can nevertheless be led out of the notch in a gentle manner. This results in a notch angle of $\alpha+\beta$ between the inlet wall 8 and the baffle wall 9 of for example, 96°. It has also proven to be advantageous if the depth T of the notch 7 amounts to between 0.16 mm and 0.20 mm. For example, the depth T amounts to 0.18 mm. Thus, the notch shape that is shown contributes not only to improving spinning stability, but also to improving yarn quality.

Figure 3:
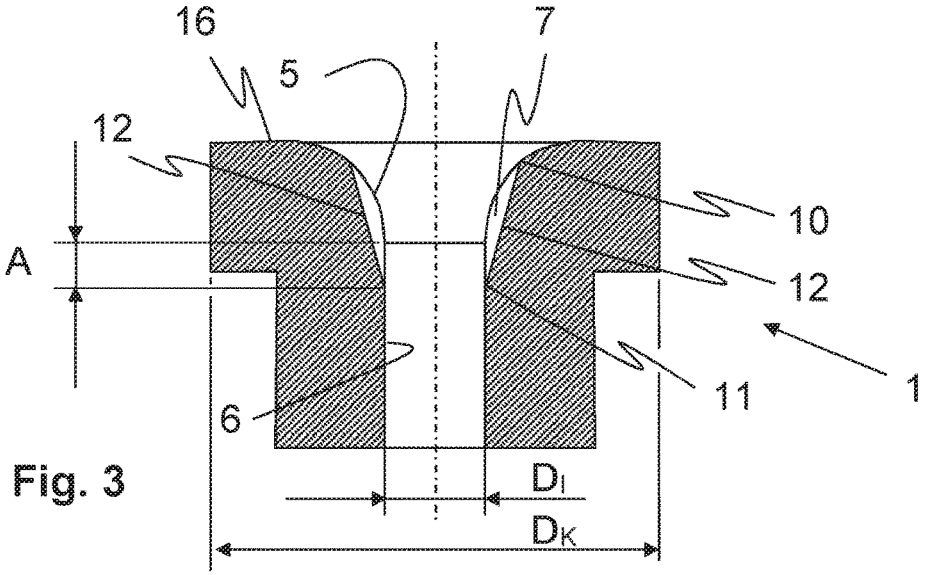
FIG. 3 is a schematic sectional view of a thread draw-off nozzle with a notch outlet in the entrance area of the nozzle bore.

FIG. 3 shows, in a schematic sectional view, a thread draw-off nozzle 1, with which the notches 7 (in the present case, two notches 7 can be seen opposite one another) extend into the nozzle bore 6. It has proved to be particularly advantageous if the notch outlet 11, which is defined in the present case by the exit-side intersection point or the exit-side intersection line of the notch bottom 12 with the inner surface of the thread draw-off nozzle 1, is at a spacing A of between 0.1 mm and 0.5 mm. For example, the spacing A amounts to 0.25 mm. The entrance of the nozzle bore 6 is defined as the beginning of the constant inner cross-section of the thread draw-off nozzle 1. By contrast, the thread draw-off nozzle 1 in the area of the nozzle funnel 5 features an ever-changing inner cross-section. In the case of a tangential transition of the nozzle funnel 5 into the nozzle bore 6, the entrance of the nozzle bore 6 is thus defined by the tangential edge shown here.

Thus, the notches 7 are in a position in which the thread F is no longer pressed so strongly onto the surface of the nozzle funnel 5. Thus, such a comparatively steep notch 7 has a positive effect on yarn quality, due to the fact that the circumferential yarn shank 4 sweeps less strongly through the notch inlet 10, and is also advantageous for spinning stability. In the case of conventional V-shaped notches, the notch inlet 10 is in turn defined by the common intersection point of the inlet wall 8 and the baffle wall 9 with the inner surface of the nozzle funnel 5 or, in the present case, by the entrance-side intersection line of the notch bottom 12 with the inner surface of the nozzle funnel.

Figure 4:
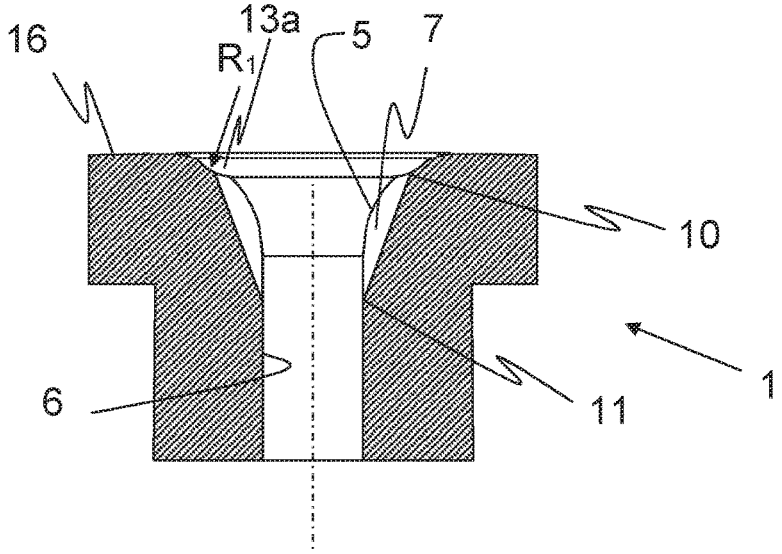
FIG. 4 is a schematic sectional view of a thread draw-off nozzle with a circumferential recess.

FIG. 4 shows an additional embodiment of a thread draw-off nozzle 1, with which the yarn-damaging effect of the notch inlet 10 is defused by a circumferential recess 13, in this case a circumferential groove 13*a*. The circumferential groove 13*a* preferably features a radius R1 of between 0.15 mm and 0.3 mm, and in the present case is designed such that it only breaks up the surface of the nozzle funnel 5. Likewise, however, the circumferential groove 13*a* could also be designed such that it reaches the front surface 16 of the thread draw-off nozzle 1. Thereby, the notch inlets 10 or the comparatively sharp transition between the curved surface of the nozzle funnel 5 and the notch 7 can be configured to be more gentle.

Figure 5:
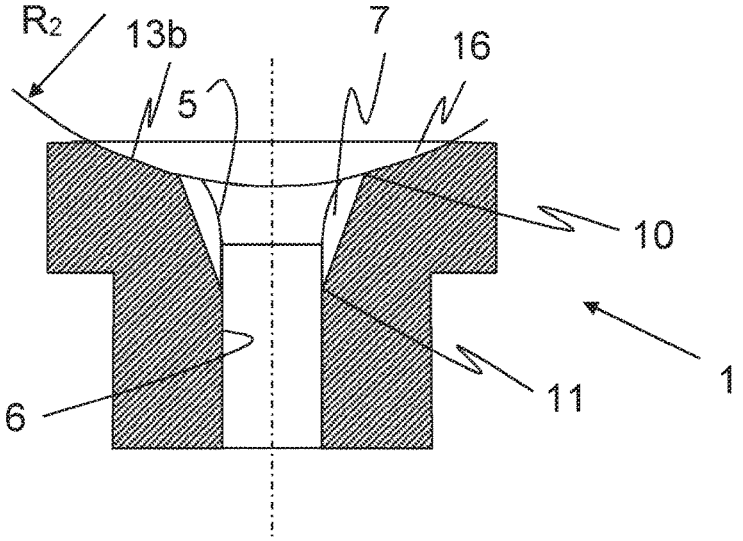
FIG. 5 is a schematic sectional view of an additional thread draw-off nozzle with a circumferential recess.

FIG. 5 shows another embodiment of a thread draw-off nozzle 1, with which the notch inlets 10 were mitigated by a spherical recess 13*b*. The radius $R_2$ of the spherical recess 13*b* is preferably matched to the inner diameter $D_I$ (FIG. 3) of the nozzle bore 6, and amounts to between $0.7*D_I$ and $0.9*D_I$. For example, the radius $R_2$ amounts to $0.8*D_I$. The aggressive, yarn-damaging effect of the notch inlets 10 can thereby be substantially reduced.

Figure 6:
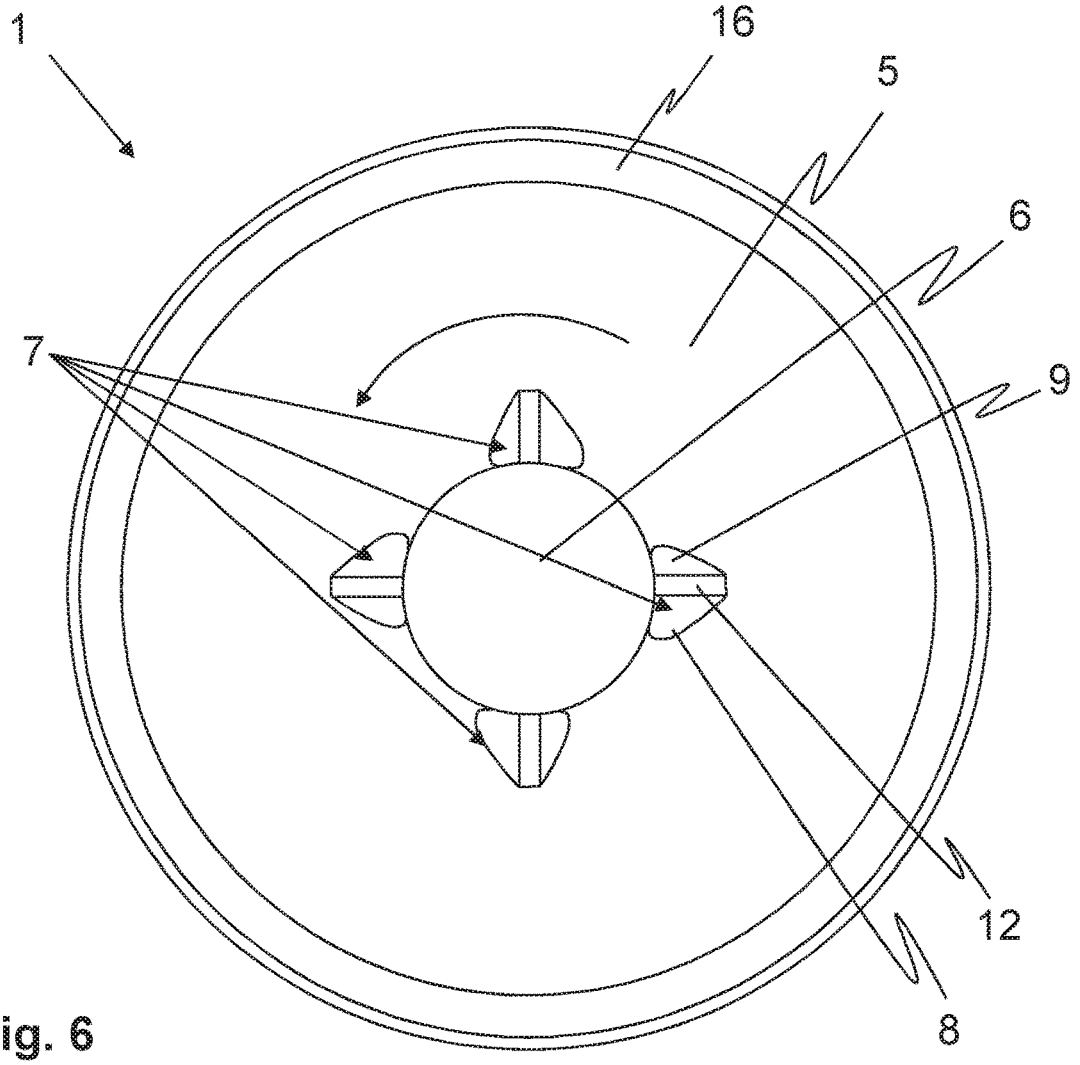
FIG. 6 is a top view of a thread draw-off nozzle with notches.

Finally, FIG. 6 also shows a top view of a thread draw-off nozzle 1 with the described notch 7 with a defined notch bottom 12. The direction of rotation of the circumferential yarn shank 4 is in turn shown by the arrow. Furthermore, the flatter inlet wall 8 and the steeper baffle wall 9 can be seen. In the present case, a total of four notches 7 are arranged evenly across the circumference; likewise, an embodiment with only three notches 7 or more than four notches 7 would be possible.

Figure 7:
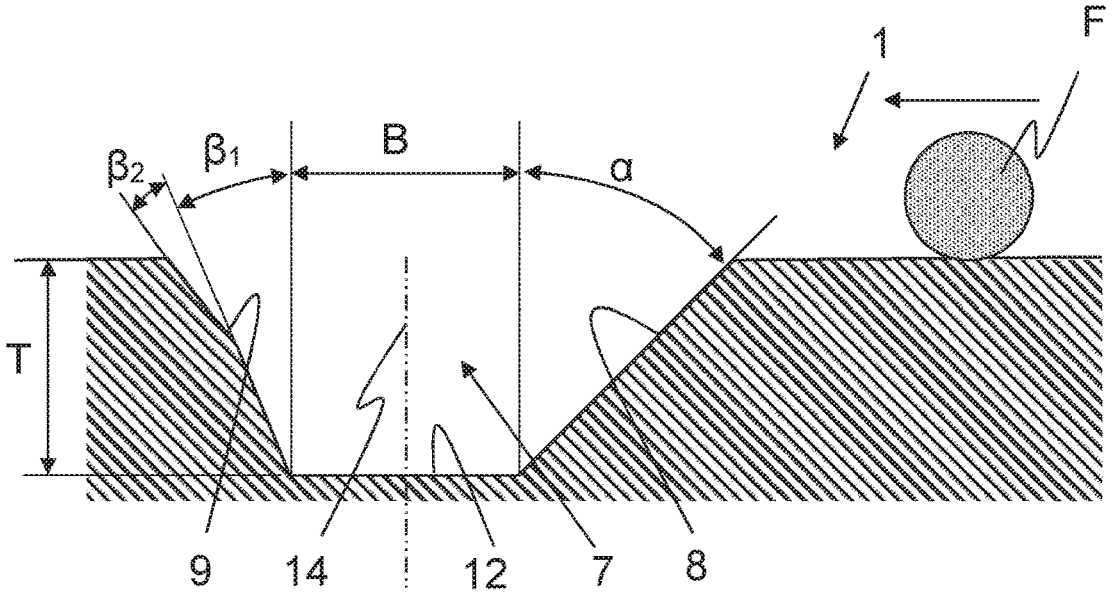
FIG. 7 is an additional embodiment of a thread-draw-off nozzle with a kinked baffle wall.
Figure 8:
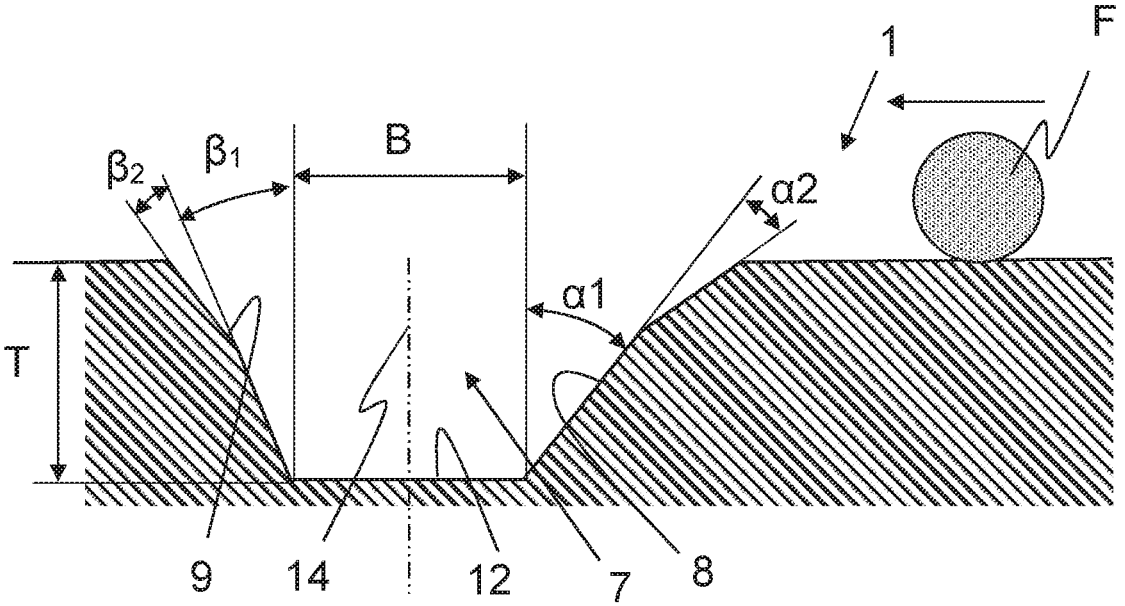
FIG. 8 is an embodiment of a thread draw-off nozzle with kinked baffle and inlet walls.

In FIG. 7, a notch 7 is shown, in which the baffle wall 9 is formed to be kinked. The first part of the baffle wall 9 turned towards the notch bottom 12 is inclined at an angle $\beta_1$ to the center notch plane 14. The second part of the baffle wall 9 turned towards the edge of the thread draw-off nozzle 1 is formed to be more flat and features a second angle $\beta_2$. With this type of notch 7, a thread treatment that is more gentle than with the notches shown above is possible, since the baffle wall 9 does not brake the thread too strongly. Such a kinked formation is also possible for the inlet wall 8, in addition to or as an alternative to the kinked baffle wall 9, as shown in FIG. 8, wherein angles $\alpha$1 and $\alpha$2 reflect the kink in the inlet wall 8.

It has been found that, in particular, with a combination of a notch 7 with a defined notch bottom 12 and a notch 7 with a notch outlet 11 within the nozzle bore 6, an optimal compromise between spinning stability, on the one hand, and yarn quality, on the other hand, can be achieved.

Modifications and variations can be made to the embodiments illustrated or described herein without departing from the scope and spirit of the invention as set forth in the appended claims.

LIST OF REFERENCE SIGNS

1 Thread draw-off nozzle
2 Spinning rotor
3 Rotor groove
4 Circumferential yarn shank
5 Nozzle funnel
6 Nozzle bore
7 Notch
8 Inlet wall
9 Baffle wall
10 Notch inlet
11 Notch outlet
12 Notch bottom
13 Recess
13*a* Groove
13*b* Spherical recess
14 Center notch plane
15 Axis of rotation of the spinning rotor
16 Front surface
B Width of the notch bottom
T Depth of the notch
F Thread
$D_K$ Head diameter
$D_I$ Inner diameter of the nozzle bore
A Spacing of the notch outlet from the entrance of the nozzle bore
α Angle of the inlet wall
β Angle of the baffle wall
$R_1$ Radius of the groove
$R_2$ Radius of the sphere

The invention claimed is:

1. A thread draw-off nozzle for an open-end rotor spinning device, comprising:

an entrance-side nozzle funnel;

an exit-side nozzle bore adjoining the nozzle funnel;

a plurality of notches arranged in the nozzle funnel and extending radial to the nozzle bore, each notch comprising an inlet wall, a baffle wall, a radially outer notch inlet, and a radially inner notch outlet;

each notch further comprising a notch bottom with a width (B) of between 0.18 mm and 0.24 mm between the inlet wall and the baffle wall;

wherein the notch inlet is in the nozzle funnel spaced apart from a front surface of the nozzle funnel; and wherein, for each notch, the baffle wall has at least one baffle wall angle, the inlet wall has at least one inlet wall angle, and the at least one baffle wall angle is steeper than the at least one inlet wall angle relative to the notch bottom.

2. The thread draw-off nozzle according to claim 1, wherein the notch outlet is arranged in an entrance area of the nozzle bore.

3. The thread draw-off nozzle according to claim 1, wherein the notch outlet is arranged at a spacing of 0.1 mm to 0.5 mm away from an entrance of the nozzle bore.

4. The thread draw-off nozzle according to claim 1, wherein the nozzle funnel comprises a circumferential recess in an area of the notch inlets.

5. The thread draw-off nozzle according to claim 1, wherein one or both of the inlet wall and the baffle wall are formed of flat surfaces.

6. The thread draw-off nozzle according to claim 1, wherein one or both of the inlet wall and the baffle wall are formed of kinked or bent surfaces.

7. The thread draw-off nozzle according to claim 1, wherein an angle ($\beta_2$) of the baffle wall to a center notch plane is between 32.5° and 47.5°.

8. The thread draw-off nozzle according to claim 1, wherein the at least one baffle wall angle comprises a first angle ($\beta_1$) and a second angle ($\beta_2$) wherein the first angle ($\beta_1$) of a first part of the baffle to a center notch plane is between 32.5° and 47.5°, and the second angle ($\beta_2$) of a second part of the baffle wall to the first part of the baffle wall is between 10° and 20°.

9. The thread draw-off nozzle according to claim 1, wherein the at least one inlet wall angle comprises an angle (α), wherein the angle (α) of the inlet wall to a center notch plane is between 50° and 65°.

10. The thread draw-off nozzle according to claim 1, wherein each notch comprises a depth (T) between 0.14 mm and 0.25 mm.

11. The thread draw-off nozzle according to claim 1, wherein the notch bottom is flat.

* * * * *